US009694273B2

(12) United States Patent
Goldblatt

(10) Patent No.: US 9,694,273 B2
(45) Date of Patent: Jul. 4, 2017

(54) GAME BOARD AND METHOD

(76) Inventor: Vivian B. Goldblatt, Paramus, NJ (US)

( * ) Notice: Subject to any disclaimer, the term of this patent is extended or adjusted under 35 U.S.C. 154(b) by 665 days.

(21) Appl. No.: 12/802,085

(22) Filed: May 28, 2010

(65) Prior Publication Data

US 2011/0291359 A1 Dec. 1, 2011

(51) Int. Cl.
*A63F 3/00* (2006.01)

(52) U.S. Cl.
CPC *A63F 3/00173* (2013.01); *A63F 2003/00258* (2013.01); *A63F 2003/00264* (2013.01); *A63F 2003/00946* (2013.01); *A63F 2003/00958* (2013.01); *A63F 2003/00962* (2013.01)

(58) Field of Classification Search
CPC .. A63F 2003/00946; A63F 2003/00958; A63F 2003/00962; A63F 3/00173; A63F 2003/00258; A63F 2003/00264
USPC ..... 273/285, 286, 287
See application file for complete search history.

(56) References Cited

U.S. PATENT DOCUMENTS

| | | | | | |
|---|---|---|---|---|---|
| 538,380 | A | * | 4/1895 | McKenzie | 273/286 |
| 2,465,418 | A | * | 3/1949 | Baker | 473/160 |
| 3,152,806 | A | * | 10/1964 | Jackman | 273/272 |
| 3,865,381 | A | * | 2/1975 | Hayes | 273/256 |
| 4,094,506 | A | * | 6/1978 | Morrison et al. | 273/108.1 |
| 4,334,680 | A | * | 6/1982 | Liversidge | 273/440 |
| 4,422,644 | A | * | 12/1983 | Holahan et al. | 273/249 |
| 4,500,091 | A | | 2/1985 | Rovsek | |
| 4,625,971 | A | * | 12/1986 | Ferguson | 273/272 |
| 4,709,927 | A | * | 12/1987 | Cline | 273/286 |
| 4,989,880 | A | * | 2/1991 | Gettemeier et al. | 273/336 |
| 5,087,052 | A | | 2/1992 | Simon | |
| 5,197,742 | A | * | 3/1993 | Bendit | 273/239 |
| 5,316,310 | A | * | 5/1994 | Nicholas et al. | 273/317 |
| 5,318,299 | A | * | 6/1994 | Beaster et al. | 273/148 R |
| 5,338,041 | A | | 8/1994 | Jones et al. | |
| 5,358,440 | A | * | 10/1994 | Zheng | 446/48 |
| 5,370,397 | A | | 12/1994 | Miller, Jr. et al. | |
| 5,497,998 | A | * | 3/1996 | Horton | 273/285 |
| 5,695,191 | A | * | 12/1997 | Frost | 273/260 |
| 5,716,033 | A | * | 2/1998 | Gibson | 248/95 |
| 6,044,877 | A | * | 4/2000 | Bennet | 141/390 |
| 6,065,512 | A | * | 5/2000 | Munn, II | 141/391 |
| 6,196,543 | B1 | | 3/2001 | Cornett | |
| 6,935,630 | B2 | | 8/2005 | Giegerich | |
| 6,953,213 | B2 | * | 10/2005 | Yardley et al. | 294/215 |
| 7,090,599 | B2 | * | 8/2006 | Hedgepath | 473/452 |
| 2003/0157466 | A1 | * | 8/2003 | Campbell | 434/150 |
| 2005/0143200 | A1 | * | 6/2005 | Hedgepath | 473/452 |

(Continued)

*Primary Examiner* — Vishu Mendiratta
(74) *Attorney, Agent, or Firm* — Gregor N. Neff

(57) ABSTRACT

Removal of game pieces or tiles from the recesses of a game board surface having a raised grid to prevent sliding of the game pieces on the board is facilitated by providing, in one embodiment, a flexible game board which can be bent into a generally U-shaped structure to form a funnel to deposit the game pieces into a receptacle by funneling action. An alternative embodiment provides for pivotably mounted full boards or portions of boards which are rotated on their pivots to deposit the game pieces in a receptacle forming the frame for the structure. Another embodiment provides a grid with a slot under it for receiving a smooth-surfaced marked game board surface under the grid. The game board can be pulled out from under the grid to let game pieces fall down into a receptacle.

6 Claims, 4 Drawing Sheets

(56) References Cited

U.S. PATENT DOCUMENTS

2006/0273510 A1* 12/2006 Pelzel et al. ..... 273/243
2008/0258387 A1 10/2008 Lu et al.

* cited by examiner

Fig. 9
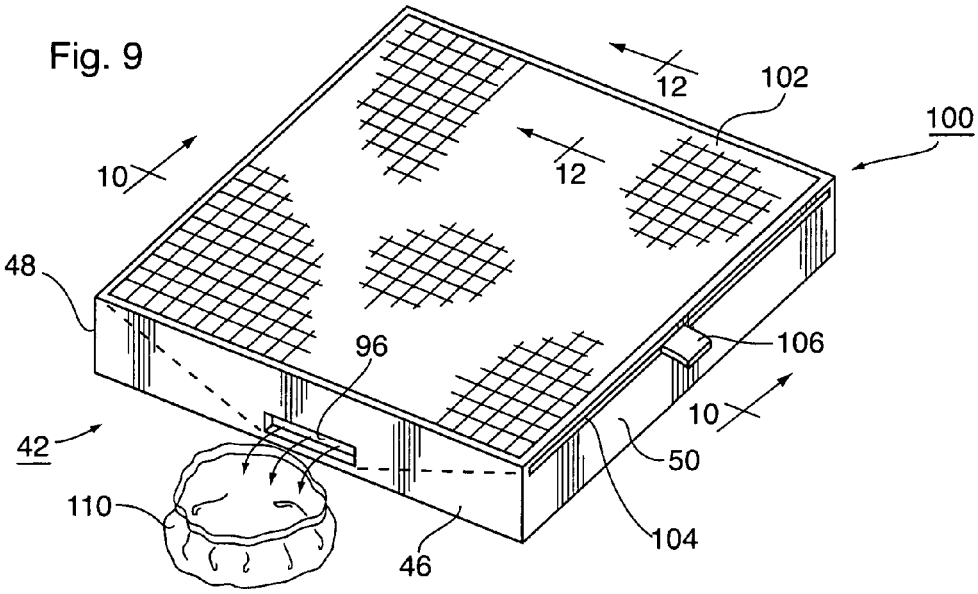
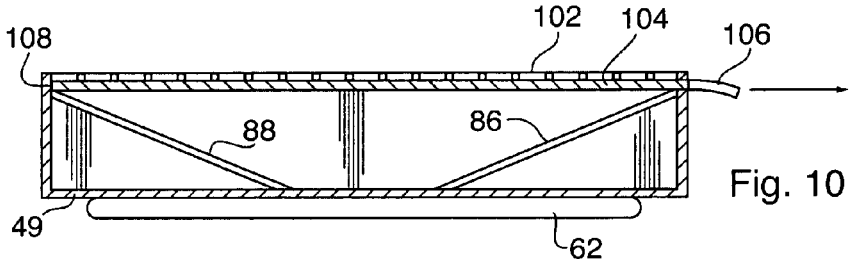
Fig. 10
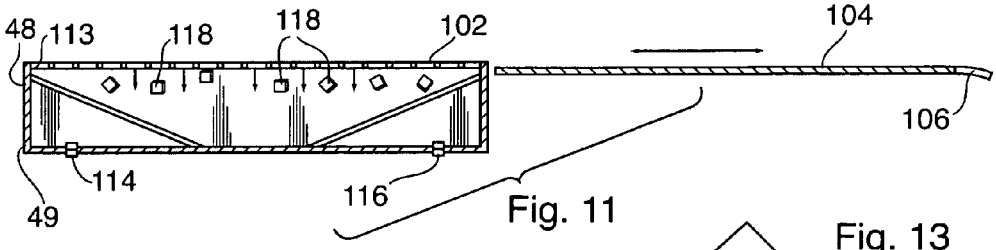
Fig. 11
Fig. 12
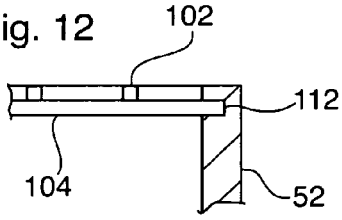
Fig. 13
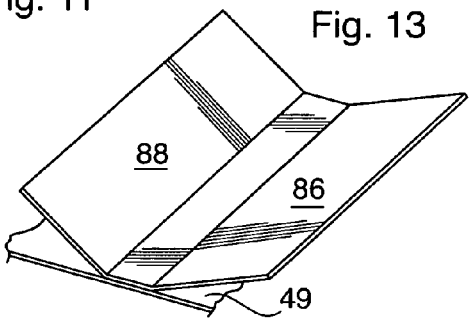

GAME BOARD AND METHOD

This invention relates to game boards, and to methods of using them. More particularly, this invention relates to game boards in which, during play, game pieces or "tiles" are positioned at various locations on the game board by multiple players, such as in "Scrabble,"™ Chess, Checkers, Bingo, etc.

In the popular game of "Scrabble" and other games using multiple tiles or game pieces positioned on a game board, the players greatly desire to prevent the game pieces from moving around after being positioned. For example, it is greatly desired to prevent the game pieces from moving when the board or the game pieces are accidentally hit by a player. To alleviate this problem, a game board with ridges separating adjacent squares from one another has been used successfully.

Some game boards are sold combined with turntables or equivalent devices on which to rotate the game board easily to bring the board in proper alignment with each of several players. A game which combines these features is known as "Deluxe Scrabble."

A problem with such game boards is that it is difficult to remove the game pieces from the board after a game has been finished in order to prepare for another game or to put the game away. Because of the ridges enclosing each of the squares, the tiles do not easily fall off when the board is tilted, with the result that often the game pieces must be removed one-at-a-time by hand. This is time consuming and annoying to the players. Various attempts have been made to solve this problem in the past, with varying but mostly moderate degrees of success.

For example, two-part game boards hinged in the middle have been provided to enable folding of the halves of the game board towards one another. This somewhat facilitates removal of the tiles. However, it is still relatively slow and cumbersome to gather the tiles from one game to ready the board for another game, or to put the game away.

Even with smooth-surfaced game boards, it often is cumbersome and slow to remove the game pieces and deposit them neatly into a receptacle for reuse or storage.

Accordingly, it is an object of the present invention to provide a game board and a method of using it which solve or greatly alleviate the foregoing problems.

In particular, it is an object of the invention to provide a game board in which game pieces or tiles can be removed from the game board surfaces relatively quickly and easily so as to increase the pleasure and decrease the annoyance of removing the tiles and depositing them in receptacles.

It is a further object of the invention to provide such a product and method which are relatively inexpensive to manufacture, simple to use, and attractive to see.

In accordance with one embodiment of the present invention, the game piece removal problem has been alleviated by the provision of a flexible game board which can be removed from a frame in which it is mounted, or it can be used separately as a stand-alone game board, with relative ease in removing the game pieces from the board.

The board preferably is made flexible in the manner of flexible plastic cutting boards for the kitchen. In use, at the end of the game, the board is removed from its frame or picked up from a flat playing surface, it is bent by hand to form a kind of funnel, and then the funnel-shaped board is tipped towards a game piece container, such as a bag or cup, and the tiles are deposited in the bag or cup by the use of gravity. Then, when the board is released, it automatically returns to a flat shape and it is again ready for use, either alone, or by mounting it in a frame, with or without a turntable or the like under it.

Alternatively, the game board can have a smooth surface instead of one having raised ridges. Its flexibility makes it useful for forming a funnel shape which will assist in quickly removing the game pieces from the board and, if desired, guiding them towards a receptacle.

In accordance with another embodiment of the invention, the game piece removal problem is alleviated by the provision of a stiff game board with a raised grid, and with a pivot mechanism to mount it in a frame. When the game is finished, the game board is pivoted on its pivot points and the game pieces slide under the force of gravity downwardly into a receptacle. Preferably, the receptacle forms part of the frame and has an exit slot or opening which allows the game pieces to exit the receptacle in a restricted area to guide the tiles into the mouth of a bag or other container.

Preferably, the pivot mounting of the game board in the frame is made easily disassemblable, so that the game board, if desired or needed, can be removed completely from the frame to a vertical or upside down position to better and more quickly remove the game pieces.

It also is a feature of the invention to provide a funnel-shaped bottom surface for the receptacle so as to funnel the game pieces towards the exit opening from the receptacle, again to speed and ease the exit of the game pieces from the receptacle.

In accordance with a third embodiment of the invention, the game board with raised grid is formed from two portions, which are mounted on a frame, on a pair of pivot axes. The axes are located so that the two halves can be tipped to deposit game pieces towards the center or the edges of the receptacle to quickly and easily remove the game pieces from the board. Again, it is preferred that the pivot structure allows each of the board halves to be removed from the receptacle completely. An exit opening from the receptacle and a funnel-shaped bottom also are preferred features of this embodiment.

In the pivotable embodiments, it is preferred to make the distance from each pivot axis slightly less than the depth of the receptacle, at least if the pivots are secured to the frame.

Alternatively, the surfaces of the pivotal board or boards in the foregoing pivoted board embodiments can be smooth, thus taking advantage of the pivoted structures to facilitate removal of the game pieces.

In a fourth embodiment, a plastic grid is secured on a frame having a receptacle beneath it. A horizontal slot is located in the frame at a position just below the grid. A smooth-surface slideable game board surface member can be slid into and out of the slot to be positioned in close proximity to the grid directly above it. The printed matter on the surface corresponds to the game being played, and the grid lines are aligned with the areas beneath them on the board.

When the game is played, the game pieces or tiles fit into the grid holes and come to rest on the surface of the game board below it. When the game is finished, the game pieces are removed quickly and easily simply by pulling the board out from under the grid so that the game pieces fall through the grid and into the receptacle below.

As in other embodiments of the invention described above, a funnel-shaped bottom structure and an exit outlet cooperating with that structure are used to deliver the accumulated tiles from the receptacle into a bag or other container.

Further features and advantages of the invention will be set forth in or apparent from the following description and drawings. In the drawings:

FIG. 9 is a perspective view of another embodiment of the invention;

FIG. 10 is a cross-sectional view taken along line 10-10 of FIG. 9;

FIG. 11 is a cross-sectional view, similar to that of FIG. 10, but showing the game board structure in a different form while it is in use to remove game pieces from the board;

FIG. 12 is a cross-sectional view taken along line 12-12 of FIG. 9;

FIG. 13 is a perspective view showing schematically the construction of the funnel-shaped bottom of the receptacle of the device shown in previous figures of the drawings.

Figure 1:
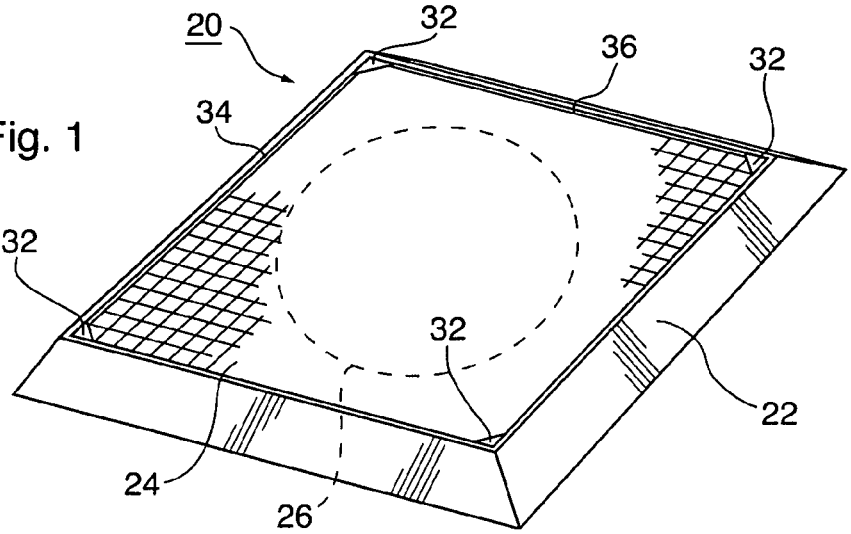
FIG. 1 is a perspective view, partially schematic of a first embodiment of the invention.

FIG. 1 shows a game board structure 20 which includes a frame 22 with sloping sides, a game board 24 mounted in the frame, and a turntable underneath, indicated in dash lines at 26. Also, a plastic understructure securing the frame 22 to the turn table 26 is provided but is not shown, for the sake of simplicity of the drawings.

Figure 2:
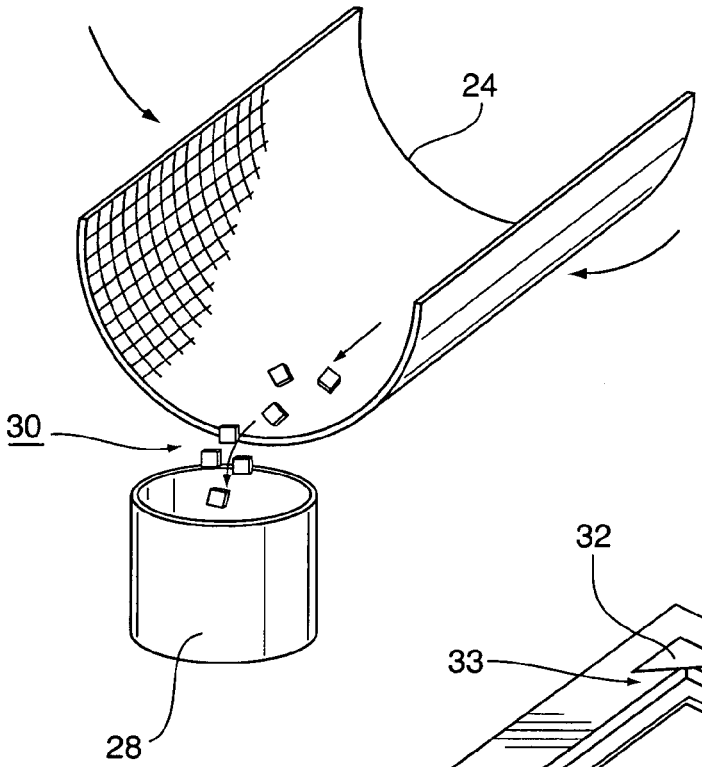
FIG. 2 is a perspective, partially schematic view of a portion of the structure shown in FIG. 1, bent into a funnel shape to remove game pieces from the flexible board.

In accordance with one embodiment of the invention, the game board 24 is made of flexible, resilient, plastic material like that used to make flexible kitchen cutting boards, so that the board 24, when removed from the frame 22, can be bent into a generally U-shaped structure as shown in FIG. 2, and will snap back to a flat shape when released.

When a game such as "Scrabble" is finished, and it is desired to remove the game pieces from the raised grid on the surface of the board 24, it is bent as shown in FIG. 2 into a generally funnel shape and then tipped to deposit the tiles by gravity into a bag or other container 28. The loose tiles falling into the container are indicated at 30.

When the hand pressure applied to the board 24 to bend it as shown in FIG. 2 is released, it returns to a flat condition. It is returned to a recess in the surface of the frame where it rests on ledges 34, 36, etc. (FIG. 3) and fits in a space 33 underneath each of four corner pieces 32.

Because it is flexible, the board can be bent upwardly in the middle to shorten it in one dimension so as to easily fit the corners under the corner pieces 32.

Alternatively, rotatable latch members can be positioned at the corners to engage the corners of the board 25 to hold them into the frame, and to ensure that the board remains flat during play. If desired, the understructure for the board frame can have one or more vertical support members to hold the board up in its center (and elsewhere, if needed) to prevent sagging.

Although FIG. 1 shows the board 24 mounted on the frame, it should be understood that it is perfectly usable as a stand-alone game board resting flat on a supporting surface.

The structure is advantageous in that it has the highly desirable feature of holding the game pieces during play, but making the game pieces relatively easy to remove when the game is finished.

Although the board preferably has a raised grid on its surface, it also can have a smooth surface and the board can be easier to remove the game pieces from due to the flexibility and resiliency of the board to enable it to be formed into a funnel shape to guide game pieces into a receptacle 28.

Figure 4:
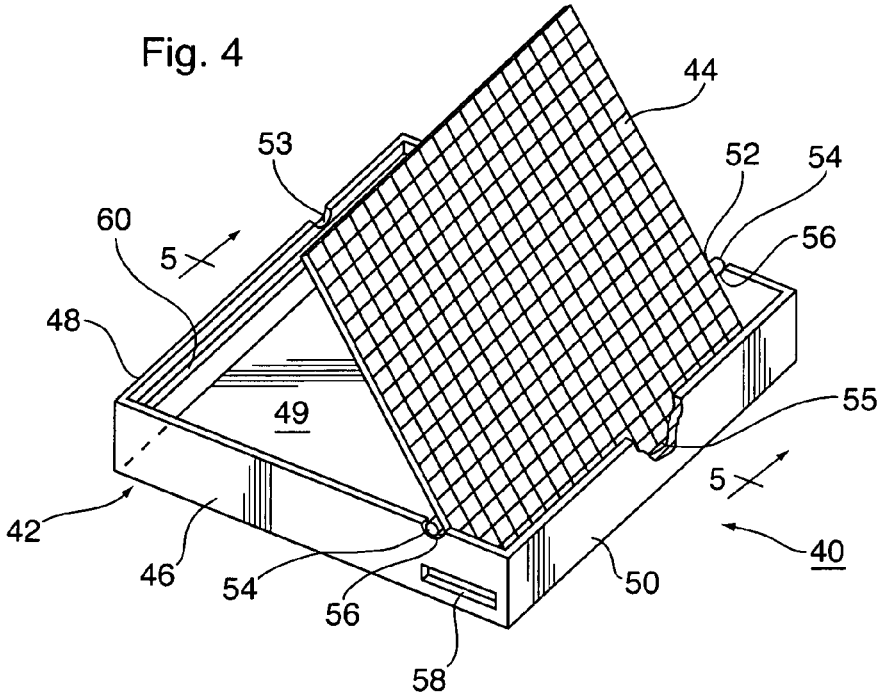
FIG. 4 is perspective view of another embodiment of the invention.

FIG. 4 shows another embodiment 40 of the invention in which a stiff plastic game board 44 with a raised grid surface is mounted in a frame which is formed by a receptacle 42. The receptacle has four side walls 46, 48, 50 and 52, and a bottom wall 49.

The board 44 has two pins or projections 54 extending from opposite side edges of the board 44. These projections or pins fit into grooves or notches 56 in the opposite side walls 46 and 52 of the receptacle which serves as a frame. A finger notch 53 is provided in the rear wall 48 of the receptacle to allow easy access to lift the board, and a ledge 60 extends outwardly from the inside surface of the wall 48 and provides a recess into which the board 44 fits when it is horizontal. In its horizontal position, the board is supported by the ledge 60 and the pins 54 resting on the bottoms of the notches 56.

An exit slot 58 is provided in the side wall 46 at a position close to the bottom wall 49 and the right side wall 50. The width of the slot 58 is determined by the width of the opening to the container to be used to hold the tiles when they are not in use. In this way, the receptacle can be tipped towards the container to allow the tiles to slide out into the container. By tipping the board 44 up to the angle shown in FIG. 4, the game pieces will slide off and downwardly into the receptacle below.

Preferably, the notches 56 are open at the top so that the pins 54 are not held in them. Thus, the game board 44 can be removed entirely from the frame and held upright at a vertical angle to the bottom of the receptacle, or even can be tipped upside down, to facilitate removal of the game pieces.

Figure 5:
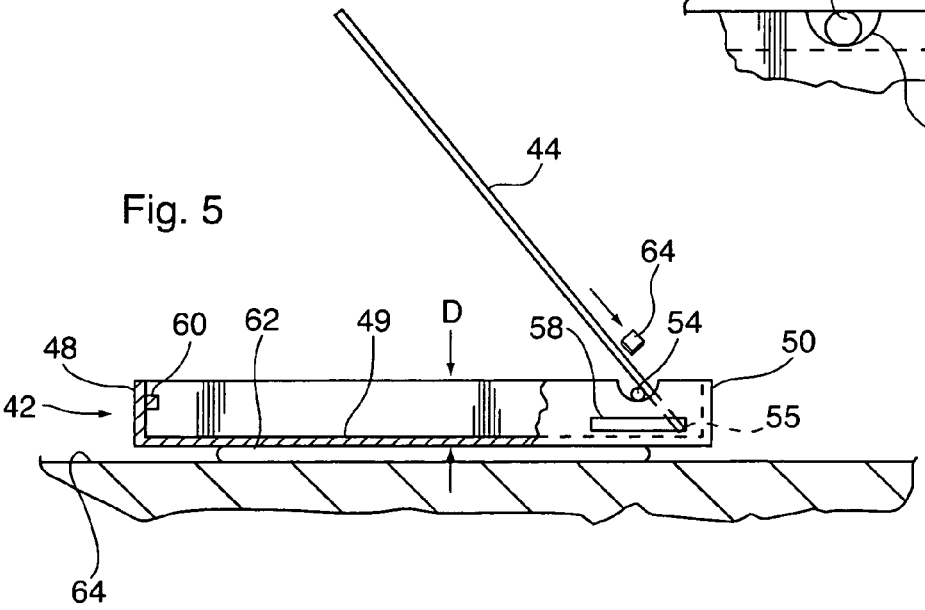
FIG. 5 is a cross-sectional view take along line 5-5 of FIG. 4 and schematically illustrating other features of the invention.

As it is shown in FIG. 5, a turntable 62 is positioned under and secured to the bottom wall 49. Alternatively, rollers or wheels can be used instead of a turn table, as will be described in further embodiments below.

Figure 6:
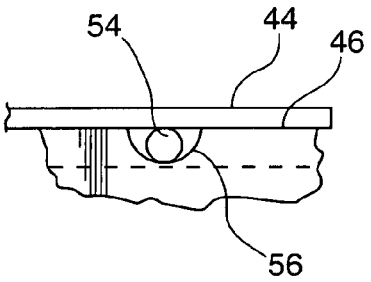
FIG. 6 is an enlarged, broken-away detail of some of the structures shown in FIGS. 1 and 2 of the drawings.
Figure 7:
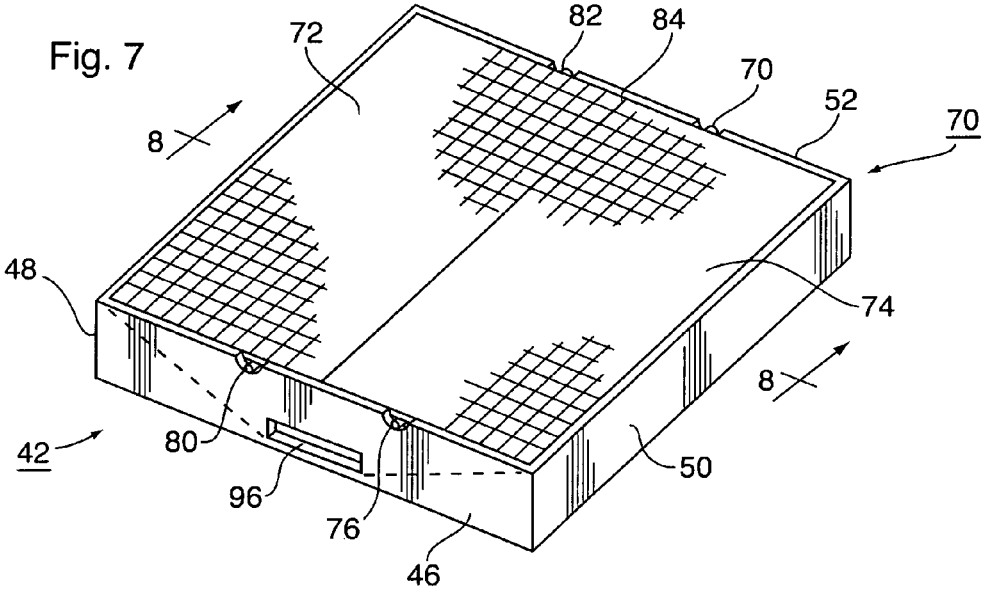
FIG. 7 is a perspective view of another embodiment of the invention.

FIG. 7 shows another game board structure 70 which is similar to that shown in FIGS. 4 through 6. However, the game board is divided into two portions, 72 and 74. Each portion has a pair of pins 80, 82, 70, or 76 which fit into grooves, like the grooves 56 shown in FIGS. 4 and 6. The side edges at the center of the structure form a joint 84. The two portions of the board fit closely together to keep the gap 84 small. The two boards swing downwardly into the receptacle below, as shown in FIG. 8, to remove tiles.

Figure 8:
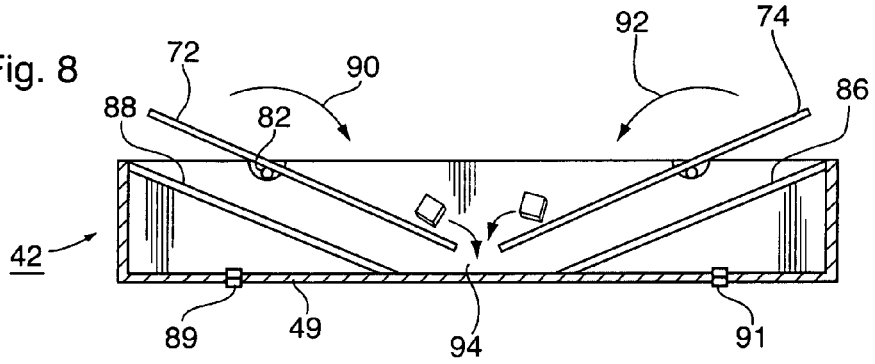
FIG. 8 is a partially schematic cross-sectional view, taken along line 8-8 of FIG. 7.

The bottom structure of the receptacle shown in FIGS. 7 and 8 is different from that shown in FIGS. 4-6. A pair of sloping wall members 86 and 88 form a funnel-shaped bottom structure so as to funnel the game pieces towards the area 94 shown in FIG. 8 when they fall from the two board halves.

The two board portions 72 and 74 preferably are swung downwardly, in the directions of arrows 90 and 92 towards the center of the receptacle 42. Referring to FIG. 7, the slot 96 is provided to dispense the game pieces into a bag or other container.

As in the embodiment of FIGS. 4 through 6, each of the portions 72 and 74 of the game board with a raised grids can be lifted completely free of the receptacle so as to more quickly and easily dislodge the game pieces from the board.

The embodiment shown in FIGS. 7 and 8 has the advantage that both of the board portions tip downwardly towards the center of the receptacle so that it is unlikely that any of the tiles or game pieces will miss the receptacle and scatter.

A further advantage of the embodiment shown in FIGS. 7 and 8 is that it is believed that the manufacturing costs can be lower due to the reduction of molding costs.

Figure 8A:
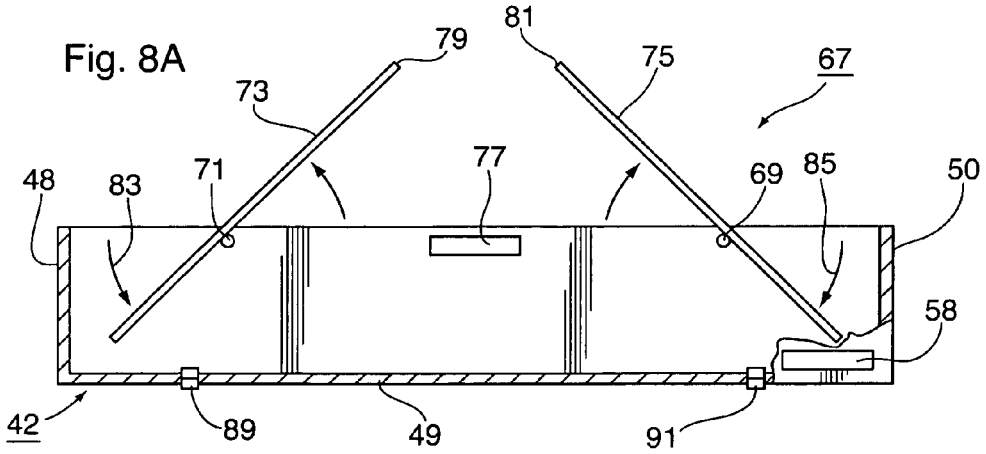
FIG. 8A is a view like FIG. 8 showing another embodiment of the invention.

FIG. 8A shows an embodiment like that of FIGS. 7 and 8, but in which the pivot pins 71 and 69 of the boards 73 and 75 are located closer to the side-walls 48 and 50, than to the center of the receptacle 42. A centrally-located stop member 77 is mounded on the inside surface of the two side walls 52 and 46 (only wall 52 is shown in FIG. 8A) to support the centrally-located edges 79 and 81 of the boards 73 and 75 closely adjacent to one another.

The boards 73 and 75 can be tilted to the position shown in FIG. 8A by pushing downwardly on the board portions between the pivot points and the left and right side walls 48 and 50 as shown by the arrows 83 and 85.

As in the embodiments of FIGS. 4-8, the boards 73 and 75 preferably can be lifted free of the receptacle 42 because the pivot projections fit into shallow notches or grooves in the side walls 52 and 46.

A game piece exit slot 58 is provided, as in the FIGS. 4-6 embodiment. As with the embodiments shown in FIGS. 1-3, the pivoted boards 44, 72, 74, 73 and 75 preferably have raised grids on their surfaces, but alternatively have smooth surfaces, to facilitate removal and guidance of game pieces into an external cup, bag or other container.

FIG. 9 is a perspective view of another embodiment 100 of the invention. Like the embodiments shown in FIGS. 4-8, a receptacle 42 is provided, and the reference numerals used in FIGS. 4-6 and 7-8 also have been used in FIGS. 9 through 13.

Mounted on the top of the frame formed by the receptacle 42 is a plastic grid 102, preferably transparent, that is used as a replacement for the built-in grids on the boards of the previously-described embodiments. Formed in the side wall 50 of the receptacle 42 is a slot which contains a smooth-surfaced game board 104 with printed indicia suitable for the game being played. For example, if the game is "Scrabble," the pattern of squares on board 104 corresponds to that for a Scrabble game. The lines of the grid 102 are aligned with the lines between the squares on the board 104.

When the game is played, the game pieces are put into the grid openings and rest on the surface of the board 104.

When it is desired to remove the game pieces or tiles from the board 102, one simply pulls on a tab 106 extending outwardly from the right edge of the board 104 and pulls it to a position such as that shown in FIG. 11. When the board 104 is thus out of the way, all of the tiles 118 fall downwardly through the open grid mesh 102 and fall to the bottom of the receptacle.

FIG. 10 shows a conventional turntable 62 secured to the bottom wall 49 of the receptacle to enable the game board to be turned to facilitate access by multiple players at a table.

FIG. 11 shows an alternative rotatable mounting scheme in which wheels 114 are mounted on the bottom wall 49 and extend a very small distance below the bottom surface of the wall 49 and roll on a horizontal surface on which the game board is played, and thus facilitate rotation of the game board.

FIG. 12 is a cross-sectional view taken along line 12-12 in FIG. 9 and shows one groove 112 of a pair of grooves in the sidewalls of the receptacle in which the game board member 104 slides. FIG. 11 shows a notch 113 in the rear wall 48 which accommodates the rear edge of the board 104 to seat it properly and maintain proper alignment of the board 104 with the grid 102.

FIG. 13 is a perspective of the bottom panels 88 and 86 forming the funnel-shaped delivery system which facilitates delivery of the game pieces out of the outlet 96 (see FIG. 9) into a container such as a bag 110.

It should be understood that a post or other vertical support can be located in or near the center of the bottom wall 49 to support the board and press it upwardly against the grid and thus keep the board from sagging.

It also should be understood that the nature of the game can be changed, say, from Scrabble to bingo or checkers simply by substituting another pre-printed panel for the panel 104 and sliding the new panel into place under the grid.

It is preferred that the embodiments shown described above be fabricated as much as possible by plastic molding. The techniques and materials for doing this are well-known and will not be described in detail here.

Variations in the embodiments disclosed can be made, within the scope of the invention.

Referring to FIGS. 4 and 5, preferably the distance from the pivot axis through the pins 54 to the right edge 55 of the game board is slightly less than the depth D (FIG. 5) of the receptacle, especially if the pins 54 are fitted into holes closed at the top to secure the board 44 to the frame rather than just resting in the notches 56. This will insure that the board 44 can be rotated to a vertical position or beyond without hitting the bottom of the receptacle.

Similarly, referring to FIGS. 7 and 8, it is preferred that each of the distances between the pivot axis 80-82 and the joint 84, and between the pivot axis 70-76 and the joint 84 for the game board portions 72, 74 be less than the depth of the receptacle, for the same purpose.

Of course, these distances can be longer, if notches are used to receive the pins with the FIGS. 4-6 and 7-8 embodiments, so that the boards can be lifted free of the frame.

In addition, if the game boards are mounted on pins resting in notches, other games can be played using the same frame and receptacle, simply by changing the game board to one for a different game.

Figure 3:
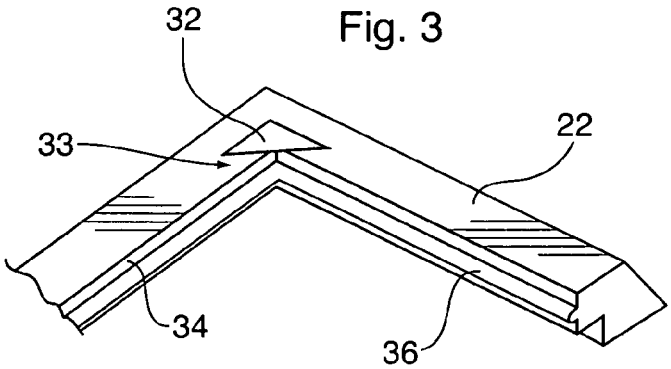
FIG. 3 is an enlarged detailed view of a portion of the structure shown in FIG. 1.

Another variation of the FIGS. 1-3 embodiment is to use a wide receptacle 42 under the board 24, and bending the board to guide the game pieces into the receptacle. This provides a larger receptacle which is hard for the game pieces to miss when they are dislodged from the board.

Although the invention has thus been shown and described with reference to specific embodiments, it should be noted that the invention is in no way limited to the details of the described arrangements but changes and modifications may be made without departing from the scope of the invention which is defined by the appended claims.

The invention claimed is:

1. A game board for bearing a plurality of game pieces distributed in a plurality of game piece locations on said game board, said game board bearing indicia defining said game piece locations, said game board comprising a normally flat solid sheet of resilient plastic material with said indicia, said sheet being bendable by hand into a substantial U-shape with said game indicia on separate parts of said board being moved towards one another, and without permanent deformation so as to return due to its resilience to a flat shape when released, in which said game board indicia include a retaining structure at each of said locations to impede sideways movement of said game piece from said location due to movement of said board or accidental contact with said game piece, said retaining structure comprising barriers on a plurality of sides of each of said locations to separate each of said locations from the others of said locations.

2. A game board as in claim 1 including a frame for holding said game board flat, and including a rotary support device supporting said frame for facilitating rotation of said board on a support surface.

3. A game board for bearing a plurality of game pieces distributed in a plurality of game piece locations on said game board, said game board bearing indicia defining said game piece locations, said game board comprising a normally flat solid sheet of resilient plastic material with said indicia, said sheet being bendable by hand into a substantial U-shape with said game indicia on separate parts of said board being moved towards one another, and without permanent deformation so as to return due to its resilience to a flat shape when released, including a frame with a holding structure for releasably holding said flat sheet in said frame in which said frame forms a receptacle below said board, and an outlet opening in said receptacle for allowing said game pieces to be poured out of said receptacle.

4. A game board for receiving game pieces distributed in a plurality of game piece locations on said game board, said game board comprising a normally flat solid sheet of resilient plastic material with game markings, said sheet being bendable by hand into a substantial U-shape without permanent deformation so as to return due to its resilience to a flat shape when released, a frame for supporting said board and holding said board flat, a turntable secured to said frame for rotatably supporting said frame and said game board above a support surface, said game board having a mesh of protruding ridges for holding each of a plurality of game pieces in position at a pre-selected location on said game board.

5. A device as in claim 4 in which said frame has a recessed ledge upon which the edge of said game board rests, and a plurality of retaining members positioned around the periphery of said ledge to engage and hold said game board seated on said ledge.

6. A device as in claim 5 in which said game board has a plurality of corners and said frame has a plurality of matching corners, and said retaining members are corner covers for each of said corners of said frame, with each of said corners of said game board fitted under one of said corner covers.

* * * * *